US005619977A

United States Patent [19]

Gatin

[11] Patent Number: 5,619,977

[45] Date of Patent: Apr. 15, 1997

[54] BALL THROWING APPARATUS WITH SAFETY FEATURE

[76] Inventor: Walter L. Gatin, RR1 S12 C64, Chase, B.C., Canada, V0E 1M0

[21] Appl. No.: 548,797

[22] Filed: Nov. 1, 1995

[51] Int. Cl.[6] ..... A63B 69/40; F41B 3/03

[52] U.S. Cl. ..... 124/7; 124/16

[58] Field of Search ..... 124/6, 7, 16, 17; 273/26 D

[56] References Cited

U.S. PATENT DOCUMENTS

| | | | |
|---|---|---|---|
| 202,301 | 4/1878 | Taltavull . | |
| 1,825,882 | 10/1931 | Mauney | 273/26 D |
| 2,080,958 | 5/1937 | Beasley et al. | 124/7 |
| 2,147,705 | 2/1939 | Hunter | 273/26 R |
| 2,585,989 | 2/1952 | Atwell | 273/26 R |
| 3,892,217 | 7/1975 | Raty | 124/7 |
| 3,977,386 | 8/1976 | Meyer | 124/7 |
| 4,082,076 | 4/1978 | Perry | 124/7 |
| 4,209,003 | 6/1980 | Sainsbury | 124/7 |
| 4,524,749 | 6/1985 | Giovagnoli | 124/7 |
| 4,538,810 | 9/1985 | Brophy | 273/26 D |
| 4,860,717 | 8/1989 | Powell et al. | 124/7 |
| 4,907,802 | 3/1990 | Gatin | 273/26 R |
| 4,995,371 | 2/1991 | Kuizinas | 124/7 |

*Primary Examiner*—John A. Ricci

*Attorney, Agent, or Firm*—Towsend and Townsend and Crew LLP

[57] ABSTRACT

A ball throwing apparatus includes an enclosure formed with an aperture and a movable gate to cover the aperture. A throwing arm adapted to receive a ball is pivotally mounted within the enclosure for movement between a ball loading position and a released position. A suction cup element holds the throwing arm in the ball loading position and releases the throwing arm from the ball loading position after a time delay. When released, the throwing arm is biased by a spring to move from the ball loading position to the released position to throw the ball. At the same time, movement of the throwing arm acts to open the gate to allow discharge of the ball from the enclosure. The use of a gate makes the ball throwing apparatus safer by enclosing the moving parts of the apparatus to make them inaccessible when in use.

28 Claims, 5 Drawing Sheets

BALL THROWING APPARATUS WITH SAFETY FEATURE

FIELD OF THE INVENTION

This invention relates to an apparatus for throwing balls, and more particularly, to a self-releasing, ball throwing arm that can be operated from a distance.

BACKGROUND OF THE INVENTION

Ball throwing devices are useful as practice devices in games that involve hitting a ball such as baseball, softball, cricket or tennis.

Prior art devices for throwing balls and supplying balls to throwing machines are well known. Examples of such devices are shown in the following U.S. Patents:

U.S. Pat. No. 202,301 to Taltavull

U.S. Pat. No. 3,892,217 to Raty

U.S. Pat. No. 4,082,076 to Perry

U.S. Pat. No. 4,209,003 to Sainsbury

U.S. Pat. No. 4,538,810 to Brophy

U.S. Pat. No. 4,524,749 to Giovagnoli

U.S. Pat. No. 4,907,802 to Gatin

Raty discloses a device that requires a human attendant to be standing by in order to aim the device and keep it supplied with balls.

Brophy discloses a baseball dispensing device that supplies balls at timed intervals to a ball throwing machines.

U.S. Pat. No. 4,907,802 is owned by the inventor and discloses a ball throwing apparatus similar the present design but without the feature of a safety gate.

The remaining patents disclose ball throwing mechanisms that use a complex arrangement of gears and cams to achieve delayed release of the balls. Many of the devices require an electric motor or similar power source to operate.

The inventor's ball throwing apparatus disclosed in U.S. Pat. No. 4,907,802, has limited marketability because the ball throwing arm is exposed and could cause injuries. To overcome this problem, the inventor has developed a new ball throwing apparatus having a throwing arm housed in an enclosure that includes a safety gate which remains closed except when the ball is being thrown. Preventing access to the throwing arm when the apparatus is in use addresses the safety concerns of the previous design.

SUMMARY OF THE INVENTION

The ball throwing apparatus of the present invention provides a safe, simple and reliable ball throwing apparatus that can be operated by a single person from a distance. Unlike prior art devices, the apparatus of the present invention requires no motorized actuating means.

Accordingly, the present invention provides a ball throwing apparatus comprising:

an enclosure formed with an aperture;

a movable gate to cover the aperture;

a throwing arm adapted to receive a ball pivotally mounted within the enclosure for movement between a ball loading position and a released position;

means for releasably holding the throwing arm in the ball loading position;

means for releasing the throwing arm from the ball loading position;

actuating means for moving the throwing arm from the ball loading position to the released position to throw the ball; and means to open the gate to allow discharge of the ball from the enclosure.

The ball throwing apparatus can be operated from a remote location and means are provided for automatically loading balls in the machine. In addition, means are also provided for adjusting the speed and trajectory of a ball being thrown. The safety gate opens only when the throwing arm is throwing a ball to prevent access to the moving parts of the apparatus thereby avoiding potential injuries.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
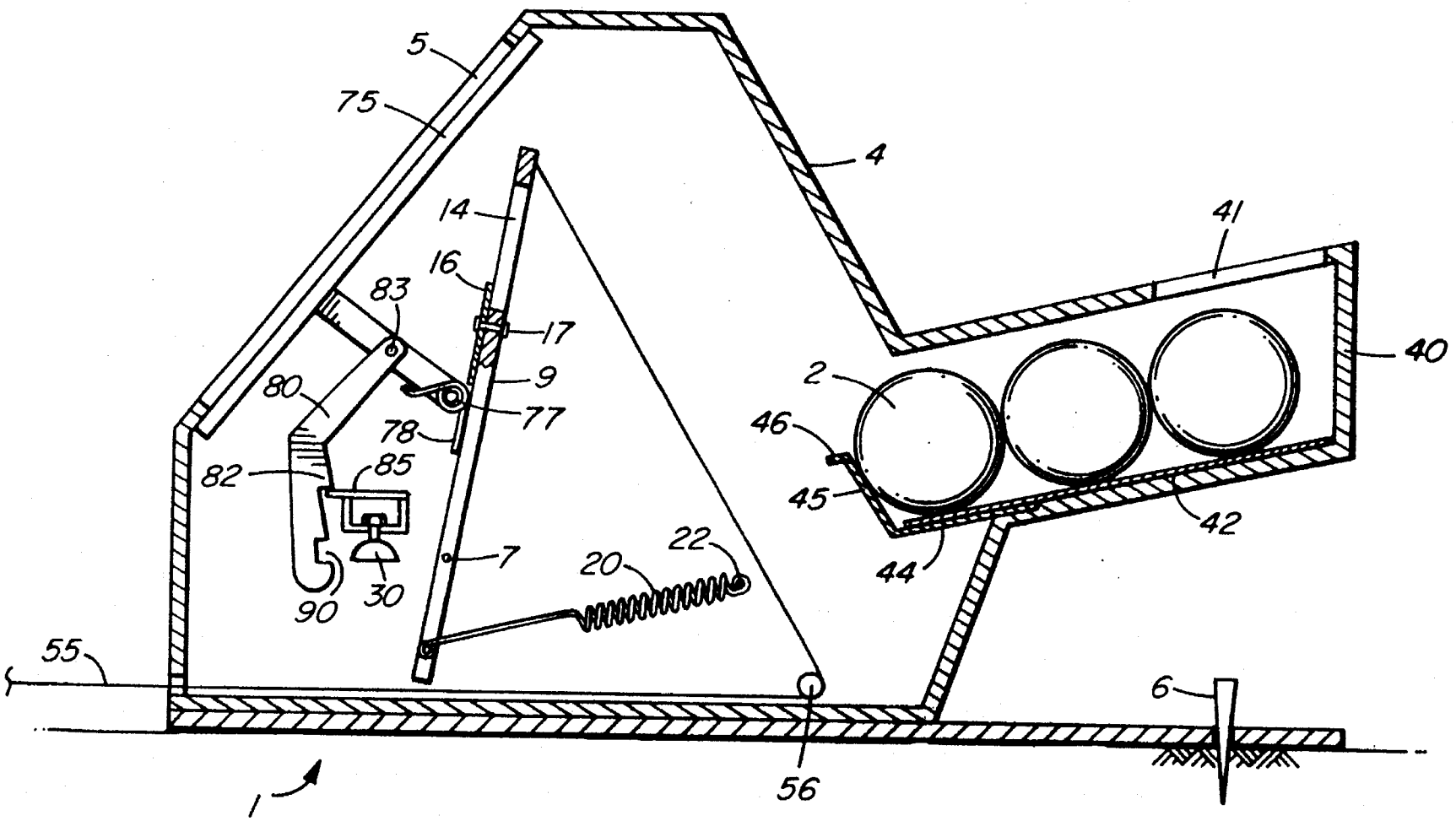
FIG. 1 is a section view through a preferred embodiment of the ball throwing apparatus of the present invention in the released position.
Figure 4:
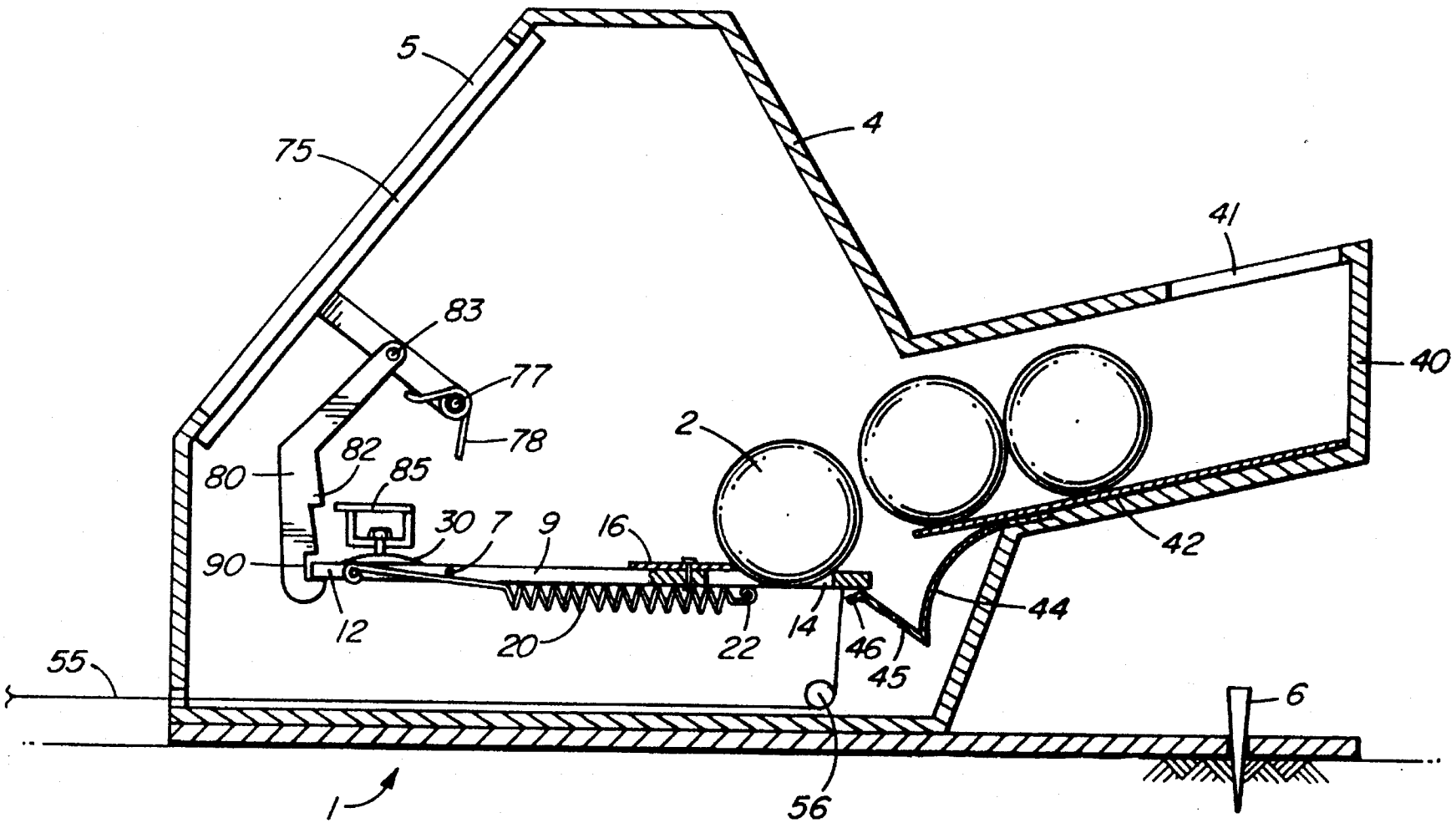
FIG. 4 is a section view showing the ball throwing apparatus in the ball loading position.

Referring to FIG. 1, a preferred embodiment of the ball throwing apparatus 1 is shown comprising an enclosure 4 having an aperture 5. The enclosure is provided with an anchor spike 6 to secure the enclosure to the ground. Pivotally mounted within the enclosure about axle 7 is a throwing arm 9. Throwing arm 9 is pivotable between the two positions shown in FIGS. 1 and 4 which are cross-sectional views through enclosure 4. FIG. 1 shows arm 9 in its released position after throwing a ball 2 and FIG. 4 shows the arm in its ball loading position prior to throwing a ball. Aperture 5 is sealed by gate 75 that is mounted within enclosure 4 for pivotal movement about axis 77. Biasing means in the form of circular spring 78 acts to pivot the gate to the closed position to prevent access to the interior of the enclosure. As will be explained in more detail, throwing arm 9 and gate 75 co-operate with each other so that the gate is automatically opened whenever throwing arm 9 moves through its throwing motion to permit discharge of the ball being thrown from the enclosure. After the ball is released from the enclosure, gate 75 closes due to the action of circular spring 78.

In the illustrated embodiment, throwing arm 9 is a generally rectangular member having a first end 10 and a second end 12. Axle 7 extends through the rectangular member intermediate the first and second ends and is rotatably supported in the walls of enclosure 4 to pivotally support throwing arm 9 within the enclosure.

Figure 2:
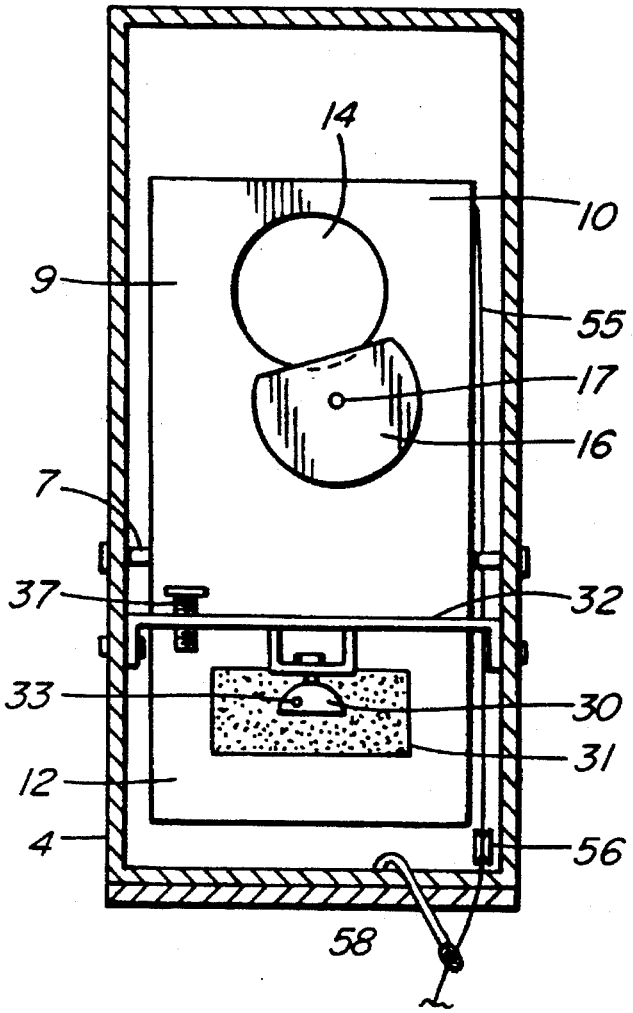
FIG 2 is a detail view of the throwing arm showing the ball receiving aperture and the suction cup element with hole for releasing pressure.

First end 10 of throwing arm 9 is formed with ball receiving means comprising an essentially circular aperture 14 in which a ball 2 is seated. As best shown in FIG. 2, aperture 14 is partially covered by means to adjust the trajectory of a thrown ball comprising a movable disc 16 mounted to the throwing arm at 17. Disc 16 can be rotated about point 17 to adjust the area of aperture 14 covered by the disc. In this manner, disc 16 affects the seating depth of the ball in aperture 14 thereby altering the trajectory of the ball when thrown by throwing arm 9. A ball that is seated deeply within ball receiving aperture 14 will tend to be released at a later time during the throwing motion of arm 9 so that a lower trajectory results. Likewise, a ball that is seated to a shallow depth will follow a higher trajectory.

Figure 5:
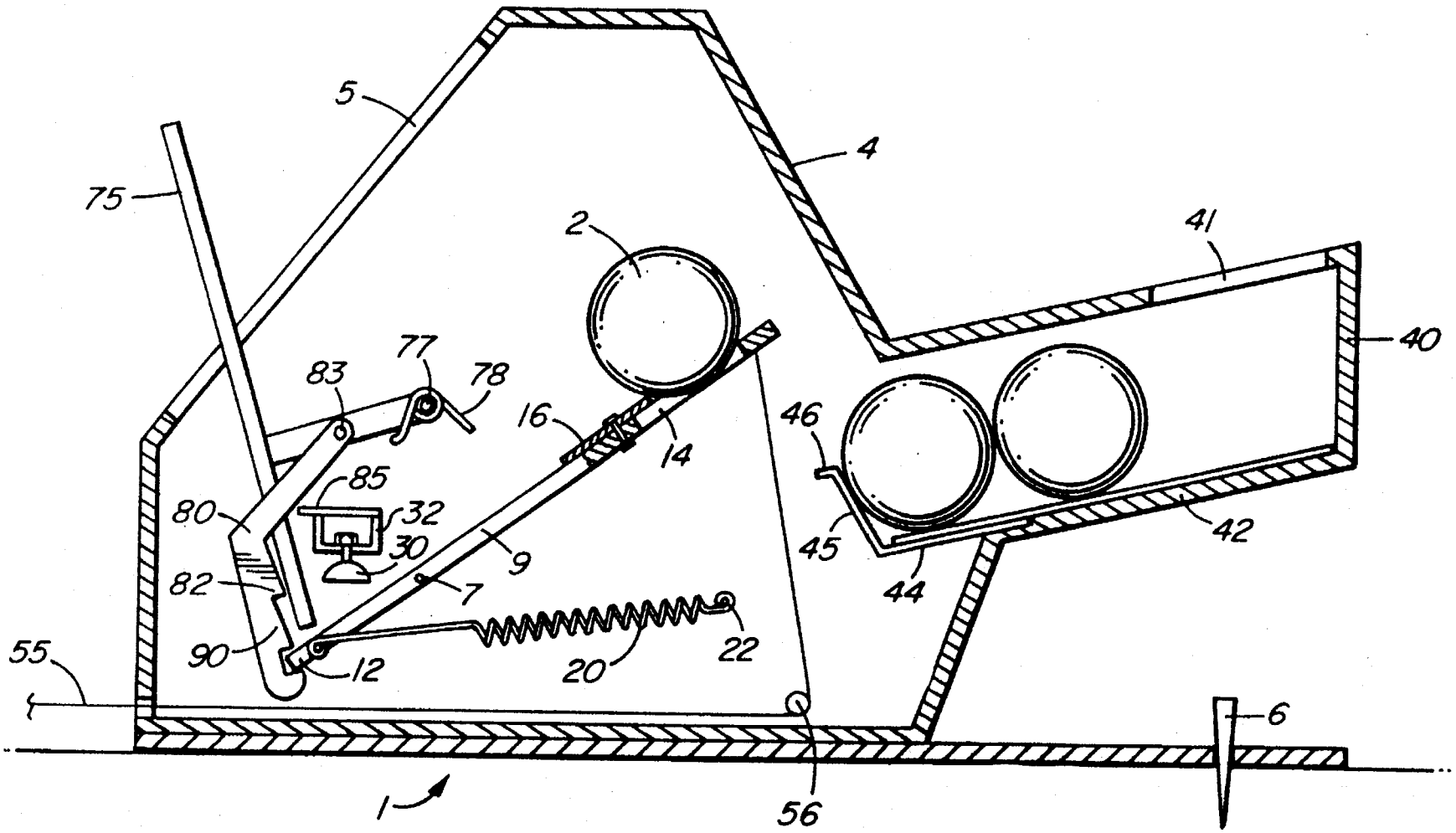
FIG. 5 is a section view showing the ball throwing apparatus throwing a ball and the gate automatically opening to allow the ball to leave the enclosure of the apparatus.

Second end 12 of throwing arm 9 has attached actuating means comprising a spring 20 that extends rearwardly toward first end 10 under the throwing arm. Spring 20 extends between second end of throwing arm 9 and post 22 that extends between the walls of the enclosure. When throwing arm 9 is moved to the ball loading position of FIG. 4, spring 20 is stretched creating a restoring force that acts to pivot throwing arm 9 from its ball loading position to its released position as shown in FIG. 1. The movement of the throwing arm 9 from the ball loading position to the released position provides the throwing motion that delivers a ball 2 as shown in FIG. 5.

Referring to FIG. 4, there are means for releasably holding the throwing arm in the ball loading position comprising a suction cup element 30 mounted beneath support member 32. Suction cup element 30 acts to hold the throwing arm in position against the restoring force of stretched spring 20. Support member 32 and suction cup element 30 are positioned within enclosure 4 such that the suction cup is depressed by the second end 12 of throwing arm 9 whenever the throwing arm is pivoted to the ball loading position of FIG. 4. Suction cup element 30 engaging second end 12 creates a suction grip on the throwing arm that holds the arm in the ball loading position against the restoring force of spring 20.

Leaking means are provided for releasing the hold of the suction cup element in order to release the throwing arm from the ball loading position. In the illustrated embodiment of FIG. 2, the leaking means comprises a small perforation 33 in the body of the suction cup that will allow for a slow equalization of pressure between the interior of the cup and the outside. At a certain point, the restoring force of spring 20 will be sufficient to overcome the weakening suction grip of cup 30 and throwing arm 9 will be released from its ball loading position. This delay allows the user time to prepare for throwing of the ball.

Figure 3:
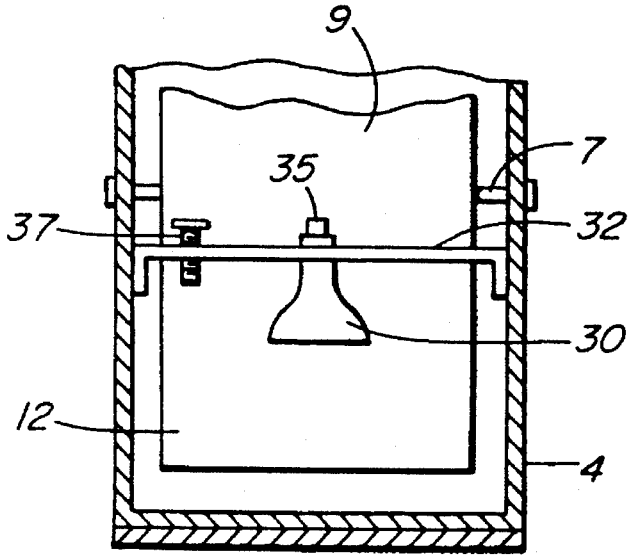
FIG. 3 is a detail view of the throwing arm showing an adjustable valve associated with the suction cup element as an alternative pressure release system.

Alternatively, as shown in FIG. 3, the leaking means can comprise an adjustable valve 35 extending upwardly from the top of support member 32 and communicating with the interior of suction cup 30. Adjusting the flow through the valve allows the user to adjust the time delay between activating the throwing apparatus by placing the throwing arm in the ball loading position and when the ball is actually thrown.

As a further alternative, the leaking means can be a non-polished or slightly roughened surface 31 on the throwing arm that prevents the suction cup element from establishing a complete seal with the arm such that slow leakage occurs about the edges of the suction cup where it engages the throwing arm.

When the leaking means comprises a perforation 33 or roughened surface 31, means to adjust the time delay of the suction cup element are provided comprising an adjustable stop member 37 that extends through support member 32. In FIG. 3, stop member 37 comprises a threaded bolt in a correspondingly threaded hole. By rotating stop member 37 in and out of the threaded hole, it is possible to vary the travel of second end 12 upward toward support member 32. Therefore, stop member 37 can be used to adjust the extent to which suction cup element 30 is depressed against the throwing arm. If stop member 37 is raised, suction cup element 32 can be depressed to a greater extent resulting in a stronger grip of the throwing arm and a longer time delay before the ball is released. Conversely, if stop member 37 is lowered, a shortened time delay will result.

At the same time that throwing arm is engaging with the suction cup element 30, end 12 of throwing arm 9 is engaging with means to open gate 75. As previously described, gate 75 is normally biased into the closed position over aperture 5 by circular spring 78. The means to open gate 75 comprises a gate release arm 80 extending from the gate and engageable with the throwing arm. Gate release arm 80 is pivotally mounted at 83 to an extension 84 extending rearwardly from gate 75. The gate release arm 80 includes locking means in the form of tooth 82 and locking plate 85. As best shown in FIG. 1, when throwing arm 9 is in the released position, gate 75 is pivoted by spring 78 to the closed position and gate release arm 80 automatically pivots downwardly so that tooth 82 engages with looking plate 85 to prevent downward travel of the gate release arm and opening of the gate.

Referring to FIG. 4, gate release arm 80 is also formed with a lower slot 90 designed to receive end 12 of throwing arm 9 at the same time that suction cup element 30 is depressed as the throwing arm is moved to the ball retaining position. Engagement of end 12 in slot 90 also pivots gate release arm 80 about point 83 to release tooth 82 from locking plate 85.

FIG. 5 shows throwing arm 9 during its throwing motion intermediate the ball retaining position and the released position. End 12 of throwing arm 9 engaged in slot 90 pulls downwardly on gate release arm 80 which causes gate 75 to swing downwardly against the force of spring 77 to open aperture 5. Gate 75 swings open to allow discharge of the ball being thrown from the enclosure. As throwing arm 9 moves to the released position, end 12 disengages from slot 90 and circular spring 77 pivots gate 75 to the closed position shown in FIG. 1 such that locking tooth 82 engages with locking plate 85. The apparatus is now ready for another cycle which is started by moving the throwing arm 9 from the released position of FIG. 1 to the ball retaining position of FIG. 4.

The ball throwing apparatus of the present invention is also equipped with ball supply means and automatic ball loading means to supply balls to the throwing arm.

The ball supply means comprises a magazine enclosure 40 having an angled base 42. Balls 2 are inserted into the magazine through opening 41 and are fed by gravity to the throwing arm.

The automatic ball loading means acts to supply the a single ball to the ball receiving means of the throwing arm each time the throwing arm is pivoted to the ball loading position. The automatic ball loading means comprises a flexible plate 44 mounted to the end of angled base 42 of magazine enclosure 40. Flexible plate 44 is formed with an upturned lip 45 at free end 46. As shown in FIG. 1 and 5, when throwing arm 9 is not in the ball loading position, flexible plate 44 lies flat against angled base 42 and lip 45 prevents balls from leaving the magazine. FIG. 4 shows the throwing arm in the ball loading position where the underside of the arm engages and depresses flexible plate 44 below angled base 42 to allow a single ball to roll in the ball receiving aperture 14.

Figure 6:
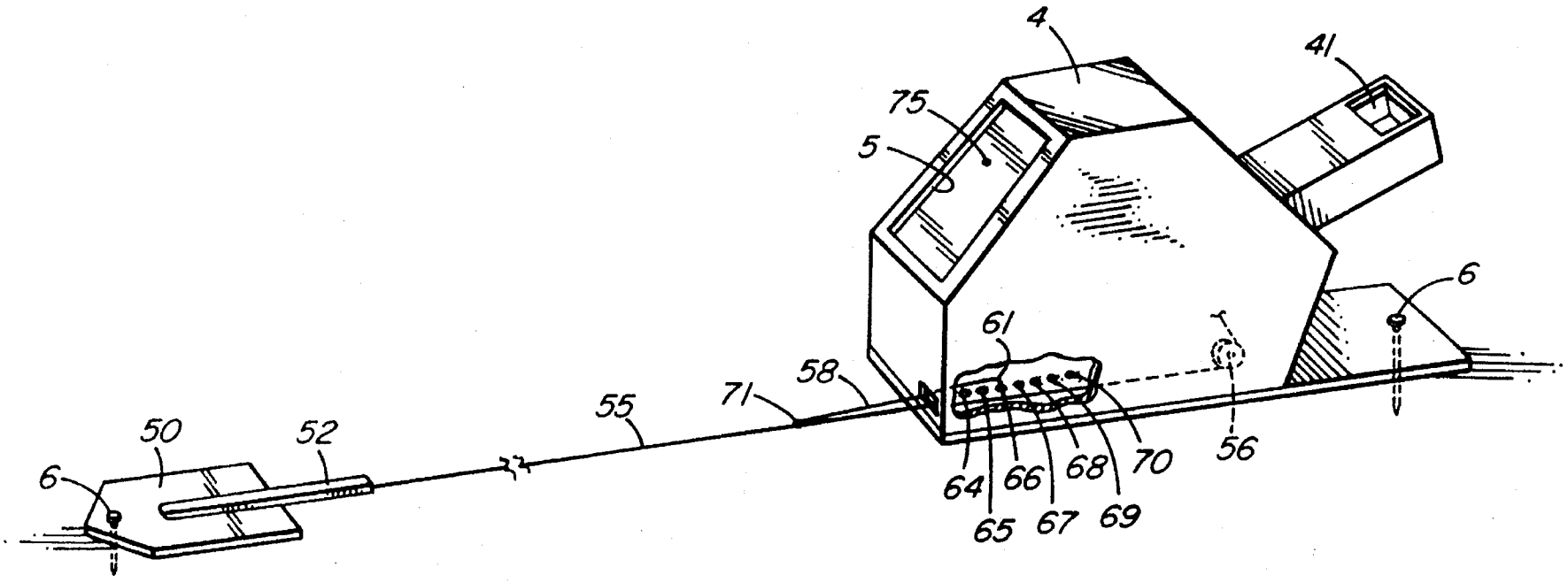
FIG. 6 shows the remote operating mechanism of the present invention with means to adjust the speed at which the ball is thrown.

The ball throwing apparatus of the present invention is also equipped with means for remotely operating the apparatus comprises a remote base 50 having an actuating lever 52 pivotally attached (refer to FIG. 6). Base 50 has a spike 6 to anchor the base to the ground. Connecting means comprising a non-stretchable cable 55 join the actuating lever to first end 10 of throwing arm 9. Cable 55 is looped about wheel 56 within enclosure 4. When actuating lever 52 is rotated at base 50 by hand, throwing arm 9 is pivoted from its ball released position to its ball loading position where the arm is held by suction cup 30.

Cable 55 is provided with means for retrieving slack comprising a resilient member 58 such as a rubber band or bungie cord extending from enclosure 4 to cable 55. Resilient member 58 causes slack in cable 55 to be brought toward enclosure 4.

FIG. 6 also shows means to adjust the speed at which the ball is thrown comprising a plurality of locations 64 to 70 on enclosure 4 to which an end 61 of resilient member 58 can be releasably attached. This arrangement serves to vary the speed at which a ball is thrown by arm 9 by acting to vary the drag force on arm 9 as it rotates between the ball loading position and its released position. Resilient member 58 extends between a fixed point 71 on non-stretchable cable 55 and an attachment point at locations 64 to 70 that can be varied by the user. When lever 52 is used to prepare the apparatus for throwing a ball, cable 55 and point 71 are pulled toward plate 50 causing throwing arm 9 to pivot about axis 7 and engage suction cup element 30 thereby placing the apparatus in the ball loading position. As cable 55 moves toward base 50, resilient member 58 is stretched creating a restoring force in the member. When lever 52 is released, the throwing arm is held in the ball loading position by suction cup element 30 and resilient member 58 acts to draw cable 55 back toward enclosure 4. The restoring force is directly proportional to the extension of the resilient member, and therefore, the restoring force is much greater when end 61 of resilient member 58 is located at position 70 than when end 61 is located at position 64 since the resilient member is stretched to a much greater extent when anchored at position 70 and lever 52 is pivoted. A greater restoring force will act to bring more slack in cable 55 toward enclosure 4 when lever 52 is released. If resilient member 58 retrieves more cable slack, arm 9 will have to do less work moving forward against the drag the cable and will therefore tend to move forward at greater speed and impart a faster velocity to the ball being thrown. In effect, resilient member 58 acts to retrieve slack in cable 55 to adjust the drag that arm 9 experiences. With the above described arrangement, attaching end 61 of resilient member 58 at position 64 will result in the slowest ball speed and attaching end 61 at point 70 will result in the fastest ball speed. The intermediate positions can be used to adjust the ball speed within this range. This arrangement provides for easy adjustment of the speed of the ball by the user.

The present invention provides a simple, safe, reliable and adjustable means for a player to practice catching or batting an accurately thrown ball without the need for a partner.

Although the present invention has been described in some detail by way of example for purposes of clarity and understanding, it will be apparent that certain changes and modifications may be practised within the scope of the appended claims.

I claim:

1. A ball throwing apparatus comprising:

an enclosure formed with an aperture;

a pivotable gate including biasing means to pivot the gate to cover the aperture;

a throwing arm adapted to receive a ball pivotally mounted within the enclosure for movement between a ball loading position and a released position, means for releasably holding the throwing arm in the ball loading position;

means for releasing the throwing arm from the ball loading position;

actuating means for moving the throwing arm from the ball loading position to the released position to throw the ball; and means to open the gate to allow discharge of the ball from the enclosure.

2. A ball throwing apparatus as claimed in claim 1 in which the means for releasably holding the throwing arm in the ball loading position comprises a suction cup element positioned to be contacted and depressed by the throwing arm.

3. A ball throwing apparatus as claimed in claim 2 in which the means for releasing the throwing arm from the ball loading position comprises leaking means for releasing the hold of the suction cup element.

4. A ball throwing apparatus as claimed in claim 3 in which the leaking means comprises a roughened surface on the throwing arm.

5. A ball throwing apparatus as claimed in claim 3 in which the leaking means comprises a perforation in the suction cup element.

6. A ball throwing apparatus as claimed in claim 3 in which the leaking means comprises an adjustable valve.

7. A ball throwing apparatus as claimed in claim 3 including timing means to adjust the holding time of the suction cup element.

8. A ball throwing apparatus as claimed in claim 7 in which the timing means comprises an adjustable stop member to control the extent to which the suction cup element is depressed against the throwing arm.

9. A ball throwing apparatus as claimed in claim 1 in which the actuating means comprises a spring.

10. A ball throwing apparatus as claimed in claim 1 in which the means to open the gate comprises a gate release arm extending from the gate and engageable with the throwing arm such that movement of the throwing arm from the ball retaining position to the released position moves the gate release arm to pivot the gate open against the force of the biasing means.

11. A ball throwing apparatus as claimed in claim 10 including locking means to prevent opening of the gate.

12. A ball throwing apparatus as claimed in claim 11 in which the locking means comprises a tooth formed on the gate release arm and a locking plate in the enclosure to engage the tooth to prevent pivoting of the gate.

13. A ball throwing apparatus as claimed in claim 11 in which the locking means is disengaged when the gate release arm is engaged with the throwing arm.

14. A ball throwing apparatus as claimed in claim 13 in which the gate release arm is pivotally connected to the gate.

15. A ball throwing apparatus as claimed in claim 10 in which the gate release arm is formed with a slot to receive an end of the throwing arm, the slot being positioned such that movement of the throwing arm to the ball retaining position automatically engages the gate release arm with the throwing arm.

16. A ball throwing apparatus as claimed in claim 1 including ball supply means with automatic loading means to deliver balls to the throwing arm.

17. A ball throwing apparatus as claimed in claim 16 in which the ball supply means comprises a container mountable to the enclosure at an angle to deliver balls by gravity to the throwing arm.

18. A ball throwing apparatus as claimed in claim 17 in which the automatic loading means comprises a flexible plate mounted to the container having an raised lip to prevent balls from leaving the container, the flexible plate being depressible by the throwing arm when the arm is moved to the ball loading position to allow a single ball from the container to be released to the throwing arm.

19. A ball throwing apparatus as claimed in claim 1 including ball receiving means formed on the throwing arm.

20. A ball throwing apparatus as claimed in claim 19 in which the ball receiving means comprises an essentially circular aperture formed in the throwing arm.

21. A ball throwing apparatus as claimed in claim 21 including means to adjust the trajectory of a thrown ball.

22. A ball throwing apparatus as claimed in claim 21 in which the means to adjust the trajectory comprises a movable disc to partially cover the essentially circular aperture to adjust the seating depth of a ball in the aperture.

23. A ball throwing apparatus as claimed in claim 1 including means for remotely operating the ball throwing apparatus comprising:

a remote base;

an actuating lever pivotally mounted to the remote base;

connecting means joining the actuating lever and the throwing arm whereby operating the actuating lever acts through the connecting means to move the throwing arm from the released position to the ball loading position.

24. A ball throwing apparatus as claimed in claim 23 in which the connecting means is a cable.

25. A ball throwing apparatus as claimed in claim 23 including means for retrieving slack in the connecting cable.

26. A ball throwing apparatus as claimed in claim 25 in which the means for retrieving slack is a resilient member mounted between the base and the connecting means.

27. A ball throwing apparatus as claimed in claim 23 including means to adjust the speed at which the ball is thrown.

28. A ball throwing apparatus as claimed in claim 27 in which the means to adjust the speed at which the ball is thrown comprises:

a plurality of locations in the base;

a resilient member connected at one end to the connecting means and the other end being adapted to releasably engage in one of the locations in the base, the end's engagement in the various locations acting to vary the extent to which the resilient member is stretched when the actuating lever is pivoted thereby varying the extent to which the resilient member brings the connecting means back toward the base such that the speed of the throwing arm is varied due to the drag force of the connecting means.

* * * * *